United States Patent [19]

Olewska

[11] Patent Number: 5,038,531

[45] Date of Patent: Aug. 13, 1991

[54] WALL STRUCTURES

[75] Inventor: Anna Olewska, Krakow, Poland

[73] Assignee: Dolmen Engineering & Systems Ltd., United Kingdom

[21] Appl. No.: 400,992

[22] Filed: Aug. 31, 1989

[30] Foreign Application Priority Data

Sep. 13, 1988 [IT] Italy ..... 21911 A/88

[51] Int. Cl.[5] ..... E04B 2/74

[52] U.S. Cl. ..... 52/64; 160/118; 160/197; 160/202; 160/235

[58] Field of Search ..... 52/64, 127.7, 127.8, 52/36; 160/202, 201, 202, 235, 218, 118, 197, 113, 118, 185, 203, 204, 205, 235, 229.1; 312/307, 308; 49/128-130

[56] References Cited

U.S. PATENT DOCUMENTS 2,257,513 9/1941 Pilcher ..... 160/235
2,672,192 3/1954 Golner ..... 160/235
2,850,089 9/1958 Burke ..... 160/202
3,199,260 8/1965 Blok ..... 52/574
3,482,706 12/1969 Stewart ..... 52/36

FOREIGN PATENT DOCUMENTS 492411 9/1938 United Kingdom ..... 160/202

*Primary Examiner*—John E. Murtagh
*Attorney, Agent, or Firm*—Lerner, David, Littenberg, Krumholz & Mentlik

[57] ABSTRACT

An assembly for forming removable, non-load bearing walls, such as partitions for offices, fairs, exhibitions, etc., consists of a plurality of generally modular panels slidably disposed between upper and lower support rails. The panels include a substantially flat central section and projecting surfaces on the longitudinal sides thereof. In assembled condition, the projecting surfaces on adjacent panels engage one another to form a continuous wall assembly.

16 Claims, 3 Drawing Sheets

Fig. 8
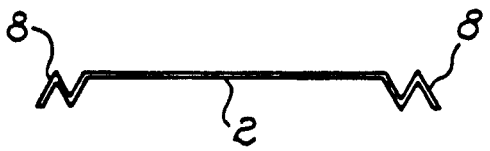
Fig. 9
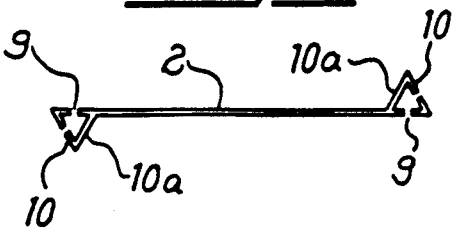
Fig. 11
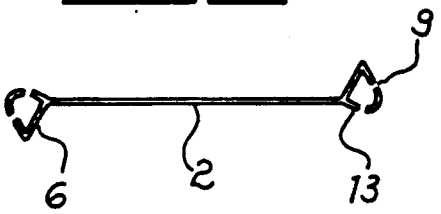
Fig. 10
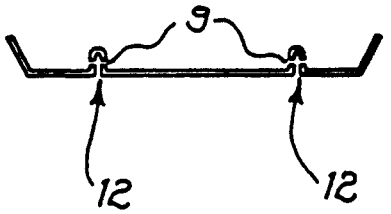
Fig. 12
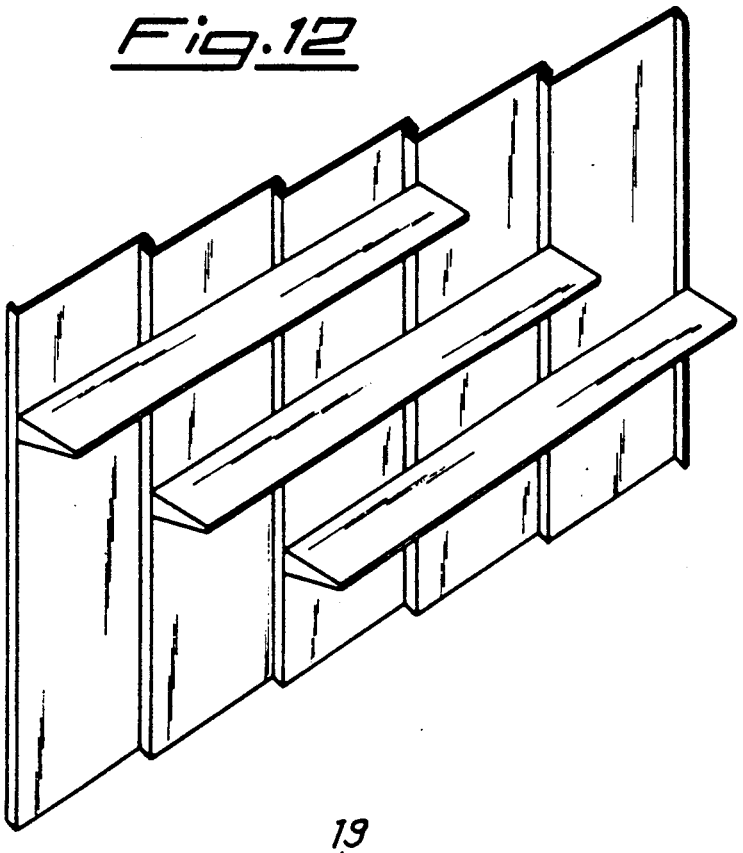
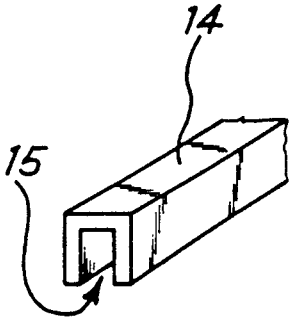
Fig. 13
Fig. 14
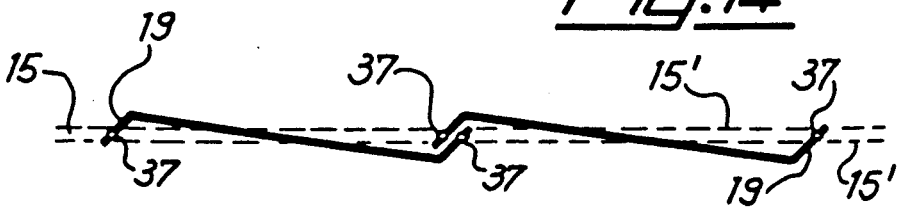

WALL STRUCTURES

BACKGROUND OF THE INVENTION

1. Field of the Invention

The present invention concerns a structure for removeable non-loadbearing walls, as for partitions in homes or offices, and in particular walls for stands or exhibition spaces in fairs, exhibitions or the like.

2. Description of the Prior Art

The problem of subdividing or zoning open space in buildings, without building walls, has been solved for some time by means which depend on what is to happen eventually to the wall. If the wall is to be semipermanent, e.g. in an office, it is usually built of prefabricated sections anchored in some way to the floor, the permanent walls and, where necessary, the ceiling. There are some differences where the wall has to be removed completely after a more or less short time, e.g. the wall separating the exhibition spaces or stands at a fair, exhibition or similar event. In this case the walls are more often made by linking aligned modular panels; at the end of the period of use the walls are dismantled and the panels are removed and stored until they are next required.

The principal disadvantage of these solutions is that in both cases the panels (and any linking mountings) are of fixed size and the length of the walls to be built is not always a whole multiple of the size of the modular panels. In such cases it is necessary to use different sized panels or to adapt one of the panels to fit the length required, with all the complications that that involves.

A further disadvantage is that once the panels have been linked together and to the supports, the resulting wall is fixed and difficult to move, and cannot be later modified without dismantling at least a part of it.

OBJECTS OF THE INVENTION

The object of the present invention is to correct the above-mentioned shortcomings and produce a modular panel wall structure that can be adapted to whatever length is required independently of the size of the panels used, and that can be modified after installation.

This object is achieved by the structure according to the invention, which makes it possible to have non-load-bearing walls, consisting of a plurality of panels, and adaptable to the dimensional requirements of each individual case.

Another object of the present invention is to produce a wall which, while being composed of standard modular elements, gives the aesthetic appearance of continuity in that it does not require those structural elements (mountings) which subdivide the traditional modular walls.

SUMMARY OF THE INVENTION

In more detail, the present invention provides for a structure of non-loadbearing walls, which can be used as partitions in living accommodations, offices, fairs, exhibitions and similar locations, of the type consisting of upper and lower support and guide elements between which are panels, generally modular, characterized by the said supports being provided with one or more longitudinal channels in which the said panels run by means of sliding devices and by the said panels being composed of a substantially flat central section and projecting longitudinal surfaces on all or part of the sides of each panel so that the panels engage each other by these projecting areas when the structure is assembled.

The structure thus obtained is easily set up, is strong, and has considerable storage advantages when not being used.

The invention will now be described in greater detail, with reference to the attached drawings, which are of an illustrative but not limiting nature.

BRIEF DESCRIPTION OF THE DRAWINGS

FIG. 8 is still another embodiment of the wall panel in accordance with the present invention;

FIGS. 9, 10 and 11 each show a transverse sectional view of a wall panel in accordance with the present invention having slots for engaging supporting elements;

FIG. 12 is a partial perspective view of a wall equipped with supporting elements;

FIG. 13 is a partial perspective view of a wall panel support and guide rail in accordance with the present invention;

FIGS. 14, 15 and 16 are plan views of possible layouts of the wall panels in the wall panel support and guide rail shown in FIG. 13;

DESCRIPTION OF THE PREFERRED EMBODIMENTS

Figure 1:
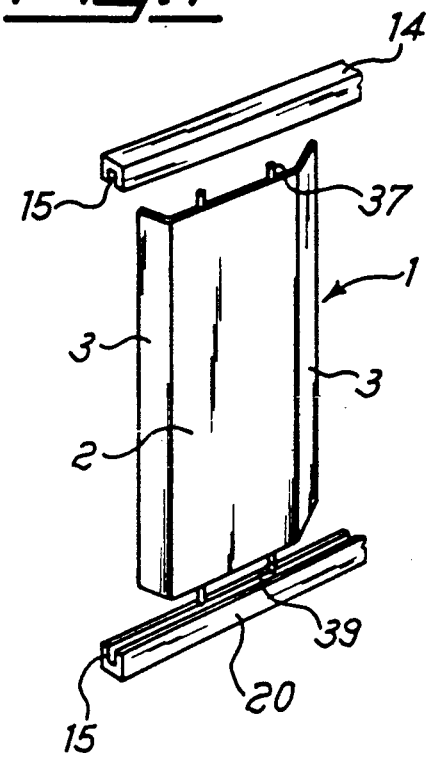
FIG. 1 is an exploded partial perspective view of one embodiment of the wall panel in accordance with the present invention.

With reference now to FIG. 1, the wall panel structure according to the invention consists of an upper support and guide element 14 and a lower support and guide element 20, between which a number of sliding panels 1 (for simplicity only one is shown in FIG. 1) are mounted; such panels are generally but not necessarily modular i.e. all of the same size. The lower support 20 and the upper support 14 are each provided with at least one longitudinal channel or guide rail in which the panels slide by means of engagement means 37 and 39 which include, for example, as studs, rollers or the like located respectively on the upper and lower edges of panel 1.

The shape of each panel is such as to have a central part 2 substantially flat, to which are linked two or more projecting parts 3, located longitudinally along the sides of each panel. Such projecting parts 3 may extend along the full length of the sides of each panel (as in FIG. 1) or, alternatively, be a series of separate projecting parts linked to the sides of the same panel (not shown).

As will be seen with reference to FIG. 17 below, when the structure is assembled each panel engages the preceding panel and the following panel by means of the said projecting parts.

The above mentioned projecting parts can be formed in various shapes, some of which are shown in FIGS. 2 to 8.

Figure 2:
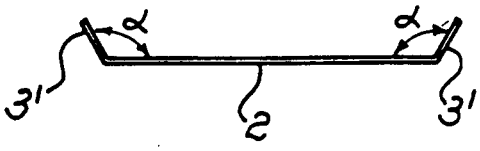
FIG. 2 is a transverse sectional view of the wall panel shown in FIG. 1.

A first preferred embodiment provides for the projections to extend from the same face with respect to the plane of the central part; FIG. 2 shows, as an example of such an embodiment, a transverse section of the panel previously illustrated in FIG. 1. As can be seen, the two projecting parts 3' consist of two wings extending from the same face with respect to the plane of the central part 2, forming substantially equal angles $\alpha$ with the same central part. The angles $\alpha$ formed by the wings 3' can vary according to the type of configuration chosen; preferably they would have values between 15 and 170 degrees (measuring every angle starting from the central part 2) and more preferably would be greater than 90 degrees. Such an angle greater than 90 would allow easier stacking of the panels for storage when not in use.

Figure 3:
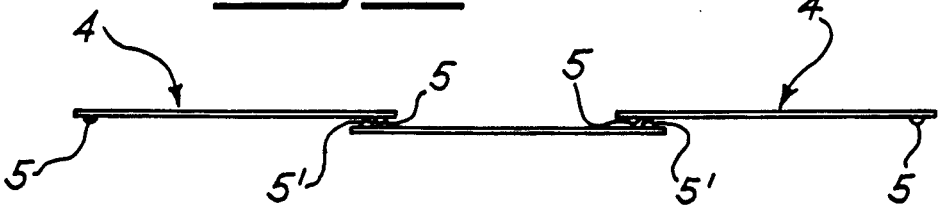
FIG. 3 is a transverse sectional view of a plurality of wall panels in accordance with another embodiment of the present invention in engagement with one another.

In place of the wings 3', the projecting parts fixed to the central part 2 could consist of seals fitted to the panels before assembly, as can be seen in the top view of three linked panels shown in the assembly of FIG. 3. As can be seen, each panel 4 is fitted at both ends of the same face with a pair of seals 5. The panels 4 are assembled into a wall structure i.e. mounted between the upper and lower supports (not shown in FIG. 3) in such a way that the two faces provided with the seals on adjacent panels face each other. In particular, each seal 5 of a panel will be located between the seals 5' of the other panel immediately adjacent thereto, as can be clearly in FIG. 3.

Alternative embodiments to FIGS. 2 and 3 can have the projections extending on opposite faces with respect to the plane of the central part, as can be seen in FIGS. 4 through 7.

Figure 4:
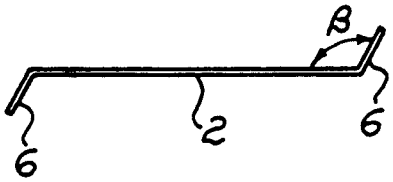
FIG. 4 is a transverse sectional view of yet another embodiment of the wall panel in accordance with the present invention.
Figure 5:
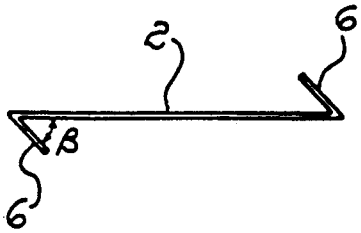
FIGS. 5, 6 and 7 each show a transverse sectional view of an alternate embodiment of the wall panel shown in FIG. 4.

FIGS. 4 and 5 show two embodiments, similar to that shown in FIGS. 1 and 2, in which the projections are formed by wings 6 integral with the central part 2. In this case the wings 6 form angles with the central part 2, shown as $\beta$ in FIGS. 4 and 5, which are preferably equal to or greater than 90 degrees. Such an angle is less critical than that indicated with reference to FIGS. 1 and 2 so far as storing the panels is concerned; in effect the angle can vary between 15 and 170 degrees, as in the example shown in FIG. 5.

Figure 6:
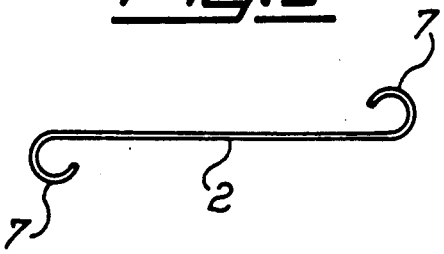
Figure 7:
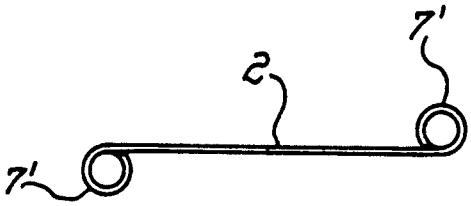

FIGS. 6 and 7 show two further alternative embodiments of the panel shown in FIG. 4 in which the projections consist of returning curves 7 or semicircular or closed curves circular 7' as are shown respectively in FIGS. 6 and 7. Also in these embodiments the parts 7 and 7' are preferably produced as extensions of the central flat part 2.

FIG. 8 shows another example of a possible shape for the projections. In this case the projections 8 extend from the same face with respect to the central part 2 and are "Z" shaped; the projections 8 could also extend from opposite faces of the central part 2, in a manner similar to that shown in FIGS. 4 to 7. The example of FIG. 8 was used to show how any shape can be used for the projections, provided that there is engagement of the panels one with the other when the structure is assembled.

Preferably, the walls created by the structure according to the invention should be able to be "equipped", where "equipped" means fitted with holders for shelves, display cases or other devices for connecting accessory elements to the same panels. As shown in FIG. 12, these accessory elements for equipping the wall can be fixed to the surface of the wall on an entirely random basis inasmuch as it is not necessary to follow the vertical uprights to fix the holders. Such ability to be equipped is preferably obtained by means of the shape of the panel shown by FIGS. 9 to 12. In the embodiments shown in FIGS. 9 and 10 such ability to be equipped is obtained by notches or slits formed at chosen points in the panels. Such points, which are indicated by 9 in FIG. 9, are located on the angle formed by the central part 2 and the projecting part 10; the free part of the projection 10 is joined to the central part 2 by a plate **10*a* in such a way as to present greater structural strength in comparison to that provided by the embodiments of FIGS. 4 or 5. In FIG. 10 the slits are set in hollows or folds 12 of the panel; such hollows also serve to increase the rigidity of the wall panel structure. on the other hand, the inherent structural rigidity of the shape shown in FIG. 7** already prepares it to be equipped.

As an alternative to the embodiments described above with reference to FIGS 7, 9 and 10, there are draw pieces 13 which, as can be seen in FIG. 11, are attached to the projection 6 preferably after the construction of the panel and, if necessary, after the erection of the structure to form the wall; in this case the notch or slit 9 is set into the draw piece 13.

FIG. 13 shows a preferred embodiment of the upper support of the structure according to the invention. As can be seen, the support 14 has a channel 15 which extends longitudinally along it and serves, as mentioned above, as a guide for the sliding device by which the panels can move along the support. In FIG. 13 the support 14 has only one channel but it is obvious that two or more channels can be made according to the preferred shaped of the structure according to the invention. Naturally, the lower support 20 (as shown in FIG. 1) has the same shape as the upper support 14.

Figure 15:
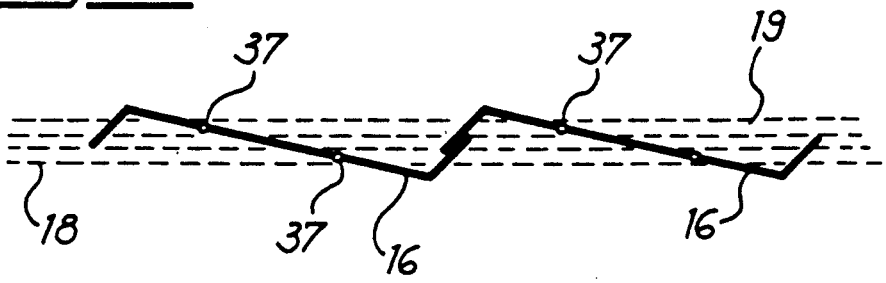
Figure 16:
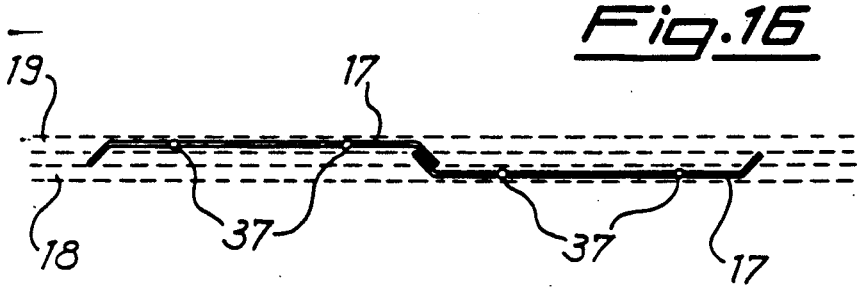

FIGS. 14 to 16 show schematically how the panels according to the invention can be engaged in the upper and lower supports.

As previously mentioned, in whatever form the embodiment according to the invention takes, the panels each engage the upper and lower supports with a pair of studs or similar elements located on the upper and lower edges of the panel. Such studs, rollers or similar elements slide in the channels of the upper and lower supports, permitting the panels to slide along the said supports. Further, the shape and size of the central and projecting parts of each panel are such as to hollow the reciprocal engagement of each panel with that immediately before and after it, when the wall structure is assembled one. In this way, moving panel which is at the end of a series of panels moves the other panels linked to it along the supports, thereby forming a continuous wall without gaps.

Referring now to FIG. 14, it can be seen that the panels (of the type already shown in FIG. 4) are fitted with studs 37 located in the channel 15, as indicated by the broken line 15. More specifically, it can be seen that the studs 37 are located on the projections 19, thus permitting the use of a single upper and lower channel for all the panels forming the structure according to the invention.

FIG. 15 shows an alternative embodiment in which each support contains two channels, as indicated by the broken lines 18 and 19, in which the studs 39 of each panel 16 are engaged. In this case, the studs of each panel engage both channels of each support.

Another embodiment of the invention is shown in FIG. 16, wherein each support contains two channels 18 and 19 similar to those of FIG. 15. This embodiment differs from that of FIG. 15, however, in that in this case the studs of each panel engage only one channel; thus the panels 17 are housed alternately in channels 18 and 19.

Figure 17:
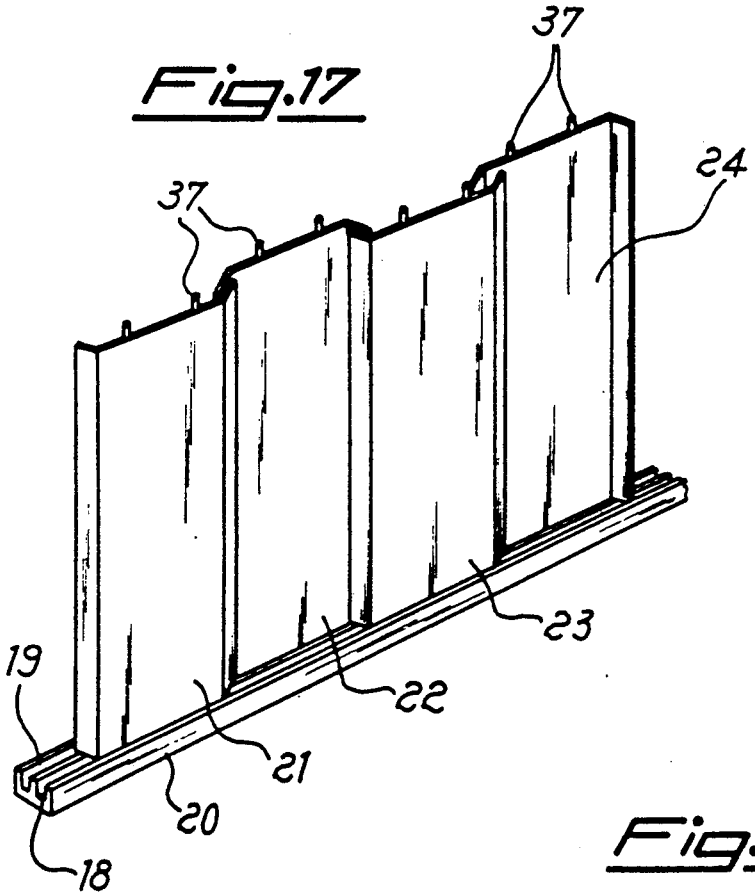
FIG. 17 is a partial perspective view of an assembled wall in accordance with the present invention.

FIG. 17 shows schematically the embodiment of FIG. 16 assembled and extended as a wall. As described above, each panel engages and is engaged by the projecting part of the panel immediately adjacent to it; this allows the structure to have great flexibility, which can be adapted to each individual case. An example of this adaptability is shown in FIG. 17 where, for the sake of simplicity, the upper support 14 has been omitted. As can be seen, the wall structure consists of four identical panels 21, 22, 23 and 24. The length of wall required is less than the length of the four panels 21–24 extended end to end, as would be provided by prior art wall structures. However, the wall structure according to the present invention allows the panel 24 (or, alternatively, any of the panels) to be partially used, thereby enabling the reciprocally linked panels to be extended to form a wall structure of the required length.

Figure 18:
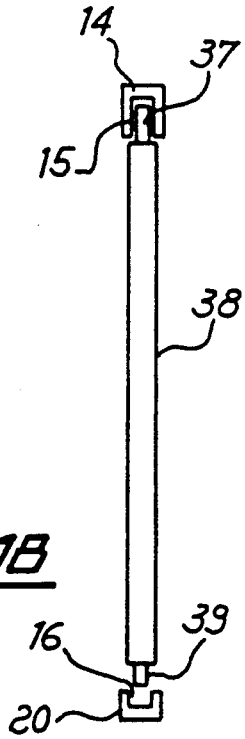
FIG. 18 is a partial sectional view showing the insertion of a wall panel of the present invention into the support and guide rails.

To facilitate the insertion and removal of the panels in the channels of the upper and lower supports, two forms of panel pins are contemplated. In the first form the length of the pin on the upper side of the panel is greater than that on the lower side; as can be seen from FIG. 18, such a configuration allows the insertion of the panel in the channels 15 of the upper support 14 and lower support 20 by the "guillotine" method, wherein the panel 38 is raised to first insert the upper pin 37 in the upper support 14, and then lowered so that the lower pin 39 engages the lower support 20.

Alternatively, the upper or lower pins may be temporarily retractable from their working position (by a spring loaded control, by rotation on a shaft, or similar device) thus facilitating the insertion and removal of the panels into and from the upper and lower supports.

The invention has been described with reference to some preferred embodiments, but it is evident that other forms can be conceived by anyone skilled in the art, without going outside the scope of protection offered by this patent.

I claim:

1. An extendable wall comprising, a plurality of panels each having a central portion disposed substantially in a plane, a top end, a bottom end and opposed longitudinal edges, support means for engaging said top and bottom ends of said plurality of panels for sliding movement in a direction transverse to said longitudinal edges between a collapsed position and an extended position, and engagement means disposed on said longitudinal edges of said plurality off panels and extending from opposite sides of said central portion with respect to said plane for engaging said longitudinal edges of immediately adjacent ones of said plurality of panels in said extended position, wherein said engagement means is operative to enable each of said plurality of panels to overlap only said immediately adjacent panels.

2. An extendable wall as claimed in claim 1 wherein said plurality of panels includes at least first, second and third consecutive panels and said support means comprises guide channel means including at least one guide channel member for engaging said top and bottom ends of at least said first and third consecutive panels.

3. An extendable wall as claimed in claim 1, wherein said support means comprise a single guide channel for engaging said top and bottom ends of said plurality of panels.

4. An extendable wall as claimed in claim 1 operative to support a plurality of display devices, and further comprising connecting means for connecting said plurality of display devices to said plurality of panels.

5. An extendable wall as claimed in claim 4, wherein said plurality of panels have structurally reinforced portions and said connecting means comprise slits formed in said structurally reinforced portions.

6. An extendable wall as claimed in claim 1, further comprising extension means connected to said top and bottom ends of said plurality of panels for engagement by said support means.

7. An extendable wall as claimed in claim 1, wherein said engagement means comprise longitudinal projections extending at an angle from said plane of said central portion.

8. An extendable wall as claimed in claim 7, wherein said angle is between about 15° and about 170° from said plane of said central portion.

9. An extendable wall as claimed in claim 1 operative to support a plurality of display devices, and further comprising connecting means for connecting said plurality of display devices to said plurality of panels.

10. An extendable wall as claimed in claim 9, wherein said plurality of panels have structurally reinforced portions and said connecting means comprise slits formed in said structurally reinforced portions.

11. An extendable wall as claimed in claim 1, wherein said support means comprise a single guide channel for engaging said top and bottom ends of said plurality of panels.

12. An extendable wall as claimed in claim 1, wherein said engagement means have a curvilinear cross-section.

13. An extendable wall as claimed in claim 1 wherein said engagement means have a Z-shaped cross-section.

14. An extendable wall as claimed in claim 1 wherein said support means comprises guide channel means including two guide channel members and said top and bottom ends of each of said plurality of panels engage both of said guide channel members.

15. An extendable wall as claimed in claim 6 wherein said extension means on said top ends of said panels are longer than said extension means on said bottom ends of said panels.

16. An extendable wall as claimed in claim 6 wherein said extension means on one of said top and bottom ends of said panels are retractable into said panels for disengagement from said support means.

* * * * *

UNITED STATES PATENT AND TRADEMARK OFFICE

CERTIFICATE OF CORRECTION

PATENT NO. : 5,038,531

DATED : August 13, 1991

INVENTOR(S) : Olewska

It is certified that error appears in the above-identified patent and that said Letters Patent is hereby corrected as shown below:

Column 2, line 58, delete "as".

Column 3, line 53, "curves circular" should read read --circular curves--.

Column 4, line 21, "on" should read --On--.

Column 4, line 54, "hollow" should read --allow--.

Column 4, line 57, after "assembled" delete --one--.

Column 4, line 57, after "moving" insert --one--.

Column 4, line 64, "15." should read --15'.--

Column 5, line 62, "off" should read --of--.

Signed and Sealed this

Second Day of March, 1993

*Attest:*

STEPHEN G. KUNIN

*Attesting Officer*

*Acting Commissioner of Patents and Trademarks*